United States Patent [19]

Palmans

[11] Patent Number: 4,697,301

[45] Date of Patent: Oct. 6, 1987

[54] BLACKBOARD RUBBER MADE OF, OR INCLUDING, METAL

[75] Inventor: Jos Palmans, Sint-Huibrechts-Lille, Belgium

[73] Assignee: Alliance Enamelsteel Corporation S.A., Belgium

[21] Appl. No.: 814,103

[22] Filed: Dec. 27, 1985

[30] Foreign Application Priority Data

Jan. 28, 1985 [LU] Luxembourg ..... 85745

[51] Int. Cl.[4] ..... B43L 19/04

[52] U.S. Cl. ..... 15/426; 15/223; 428/900; 428/99

[58] Field of Search ..... 15/223, 424, 425, 426, 15/224, 208, 209 R, 118; 428/99, 900

[56] References Cited

U.S. PATENT DOCUMENTS 3,110,917 11/1963 McPeek ..... 15/223

*Primary Examiner*—Alexander S. Thomas

*Attorney, Agent, or Firm*—Darby & Darby

[57] ABSTRACT

Blackboard rubber made of metal or having a metal base made up of two parts enclosed one within the other, the first part being in the form of a rectangular box and the second part being flat and forming a lid to the first part; the said second part comprises a centered metal plate and a magnet and is covered with a detachable rubbing sheet of soft material.

11 Claims, 7 Drawing Figures

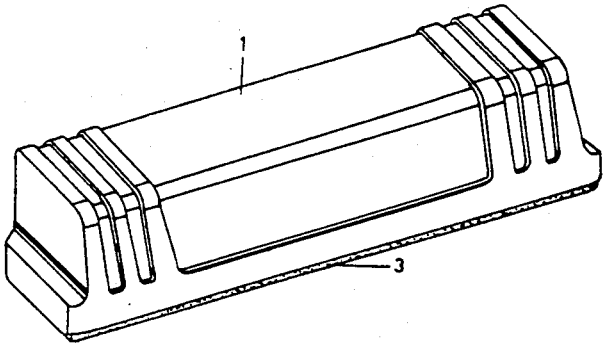
FIG.1
FIG.2
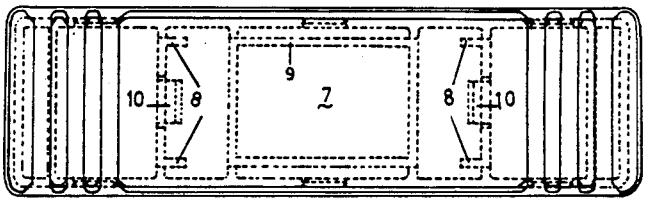
FIG.3
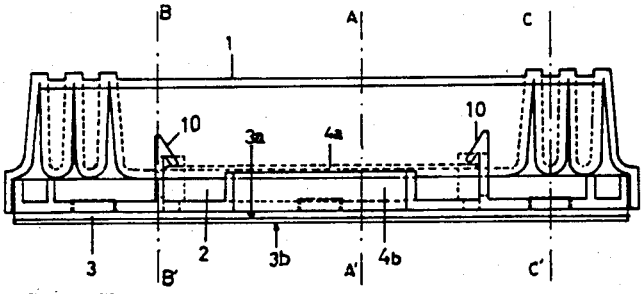
FIG.4
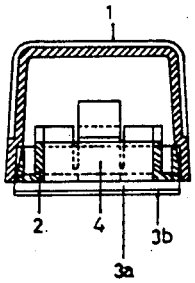
FIG.5
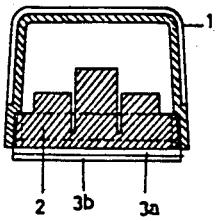
FIG.6
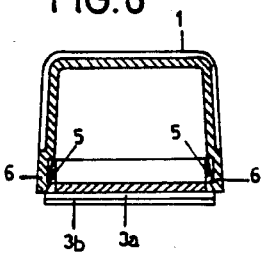
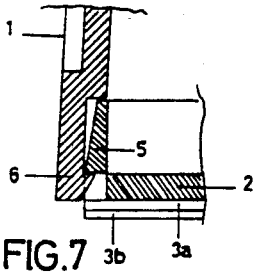
FIG.7

BLACKBOARD RUBBER MADE OF, OR INCLUDING, METAL

FIELD OF THE INVENTION

This invention concerns a blackboard rubber made of plastic or other material, and a metal or ceramic part forming a magnet which keeps and attracts the rubber against the metal board, generally an enamelled plate providing the base for a text, drawing and other matter recorded with a marker pencil leaving a very thin layer of dust on the base, a film which can be eliminated simply by rubbing, hence rubbing out the text, drawing etc.

The purpose of this invention is to provide a rubber of simple design making it possible to rub out inscriptions on a metal surface, without the operator having to apply pressure, and in addition, the rubber can be placed, and retained, against the board.

SUMMARY OF THE INVENTION

The rubber in accordance with the invention is very simply made and nevertheless particularly easy to use. It is made up essentially of two parts enclosed one in the other; it is characterized by the fact that one part, the first, is of the general shape of a rectangular box, the height of which is approximately 3 to 10 cm, so that it can be gripped between the thumb and fingers of the hand, and the other part, the second part, is of a generally flat shape of such dimensions that this part can be placed on and into the first part in such a way as to form the missing face of the first part, each part at various peripheral points having end-to-end connections and tongues in the form of hooks engaging with stops respectively on each of the two parts, and by the fact that such second part includes and holds a metal plate centred in relation to its periphery and at least one magnet placed behind a strip of adhesive felt or other soft material such as quilted paper making it possible to rub without scratching an enamelled board or wall, that is therefore likewise metallic, such strip covering the whole surface of the second part and being generally suitable, after intensive use, for withdrawal and replacement by another one.

The essential advantage of the rubber in accordance with the invention is that it is held against the outside surface of a board or enamelled wall and that it can be moved simply by sliding in any direction without having to grip it and press it against the board or enamelled wall.

BRIEF DESCRIPTION OF THE DRAWINGS

In order to understand the invention better and to bring out its characteristics, it is described below in reference to drawings which show:

in FIG. 1: a general perspective view of a rubber in accordance with the invention;

in FIG. 2: a plan view of the rubber in accordance with FIG. 1;

in FIG. 3: a side view in vertical section of the rubber in accordance with FIG. 1;

in FIGS. 4, 5 and 6: vertical sectional views along the lines A-A', B-B', C-C' respectively, of FIG. 3;

in FIG. 7: an enlarged part-view of FIG. 6.

In these different figures is shown a rubber made up of a first part (1) forming the outside body into which is inserted and held a second part (2) forming the rubbing side and which is covered by an adhesive strip (3*a*) and a strip of felt (3*b*) or similar material, the inside surface of which (3*a*) may be an adhesive strip on which the rubbing material (3*b*) may be placed. The two parts (3*a* and 3*b*) may be replaced by a single self-adhesive material which can be interchangeable.

The outside body or first part (1) may be of any agreed material and for example, as shown, moulded in an A B S plastic material, that is, formed of an acrylonitrile butadiene styrene copolymer, and suitable for vat dying.

According to this invention, the two parts (1) and (2) are enclosed one in the other in such manner that the second part can be fitted into the first like the closing lid of the "box" (1) formed by the first part. The said second part (2) is advantageously anchored in the first by means of end-to-end connections by tongues in the form of hooks (5) engaging with stops (6). Such means of connection are advantageously distributed over the inside periphery of the first part (1).

The second part (2) comprises a metal plate (4*a*), composed of ceramic or including another metal, plate (4*a*) for example being centered and covering part of the length of the rubber. Any other arrangement can of course be provided, for example a set of three magnets, the two outside ones for example having a magnetic pole differing from that of the centre.

The metal plate (4*a*) is advantageously attached in adequate manner to the second part (2), for example by known means of attachment by means of assembly using a dog clutch, sticking with a two-way adhesive or screwing. Any other equivalent means to achieve the anticipated result is of course similarly covered by this invention. The magnet (4*b*) is able by its magnetic force of attraction to adhere to the metal plate (4*a*).

In accordance with a preferred form of embodiment of the present invention, the second part (2) has a centred aperture (7) in or on which the metal plate (4*a*) can be arranged. This is kept in position (FIG. 3) by means of hooks (10). The exact position of such said plate (4*a*) is secured by the edges (9) of the aperture (7) and the hook-shaped tongues (10).

The rubbing sheet is conveniently replaceable and is detachably connected to the rubber.

It will be seen that this invention provides a very simple and very manageable rubber for cleaning a metal bord without the user having to apply great effort to the rubber to erase inscriptions, drawings, etc. from the board.

On the other hand, thanks to the choice of an adequate magnetic system, the force of application of the rubber to the board can be regulated in such manner that the writing is conveniently removed and the board itself undergoes minimum possible damage through wear, the user's hand, according to this invention, doing no more, in principle, than guide the said rubber.

The first part (1) of the rubber according to this invention conveniently possesses an appropriate ergonomic form to which any user's hand can easily adapt.

It is very clear that this invention is not restricted to the form of embodiment described but extends to the framework provided by the claims.

I claim:

1. Blackboard rubber made of or including part metal, characterized by the fact that it is essentially made up of two parts enclosed one within the other of which a first part has the general shape of a rectangular box and of which the second part is of a generally flat shape the dimensions of which are such that this part can be placed on and in the first part in such manner as to form the missing face of the first part and that the said second part includes a metal plate to which is attached a magnet.

2. Rubber according to claim 1 characterized by the fact that the said second part is covered outside by a strip of adhesive material to which a strip of soft material can be stuck.

3. Rubber according to claim 1 characterized by the fact that the strip of soft material consists of a layer of felt or quilted paper.

4. Rubber according to claim 1 characterized by the fact that the said strip of soft material may be withdrawn and replaced by another strip.

5. Rubber according to claim 1 characterized by the fact that the said first and second parts are linked at different peripheral points by abutment tongue connections in the form of hooks on the one part, engaging with stops on the other part.

6. Rubber according to claim 1 characterized by the fact that the magnet is centred and covers part of the length of the said rubber.

7. Rubber according to claim 1 characterized by the fact that the second part includes a set of two to three magnets, the two outer ones having a magnetic pole of attraction differing from that of the centre one.

8. Rubber according to claim 1 characterized by the fact that the metal plate is attached by adhesive, screws or by dog clutch to the second part.

9. Rubber according to claim 1 characterized by the fact that the second part has a centred aperture in or on which the metal plate can be arranged which is maintained in centred position by being squeezed between the edges of the aperture and the hook-shaped tongues and metal plate which positions the magnet or magnets in such manner that the option to replace the rubbing material remains an easy one without disturbing the magnetic system and possibly without having to have recourse to an adhesive strip.

10. Rubber according to claim 1 characterized by the fact that it consists of a moulded synthetic material such as acrylonitrile butadiene styrene, for example.

11. Rubber according to claim 1 characterized by the fact that the first part is shaped so as to fit into the hand of the user, having a height between 3 and 10 cm.

* * * * *